US006339690B1

(12) United States Patent
Karasawa

(10) Patent No.: US 6,339,690 B1
(45) Date of Patent: Jan. 15, 2002

(54) ELECTROPHOTOGRAPHIC APPARATUS HAVING SCREENING MEMBER FOR RECYCLING TONER

(75) Inventor: Kazunori Karasawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/614,763

(22) Filed: Jul. 12, 2000

(30) Foreign Application Priority Data

Jul. 12, 1999 (JP) ..... 11-197284

(51) Int. Cl.[7] ..... G03G 21/10
(52) U.S. Cl. ..... 399/253; 399/359
(58) Field of Search ..... 399/253–255, 399/358, 359

(56) References Cited

U.S. PATENT DOCUMENTS 4,054,381 A * 10/1977 Bernhard ..... 399/359
4,389,968 A * 6/1983 Satomura ..... 399/359
4,962,394 A 10/1990 Sohmiya et al.
5,006,896 A 4/1991 Koichi et al.
5,038,175 A 8/1991 Sohmiya et al.
5,200,788 A * 4/1993 Thayer ..... 399/359
5,455,666 A * 10/1995 Saito et al. ..... 399/359
5,500,720 A 3/1996 Karasawa
5,710,960 A * 1/1998 Hart et al. ..... 399/253
5,734,957 A * 3/1998 Ogawa et al. ..... 399/359
5,852,757 A * 12/1998 Tooda et al. ..... 399/359 X
5,950,062 A * 9/1999 Yahata et al. ..... 399/358
6,108,511 A * 8/2000 Kutsuwada et al. ..... 399/359

FOREIGN PATENT DOCUMENTS

JP 7-210050 8/1995
JP 10-105013 4/1998
JP 10-260583 9/1998

* cited by examiner

*Primary Examiner*—William J. Royer
(74) *Attorney, Agent, or Firm*—Oblon, Spivak, McClelland, Maier & Neustadt, P.C.

(57) ABSTRACT

An electrophotographic apparatus which forms an electrostatic latent image on a photoreceptor includes a developing device configured to accommodate a two-component developer including toner and carrier and to develop the electrostatic latent image with the developer. Toner which has been used for developing the electrostatic latent image is recycled to the developing device so as to be used again. The developing device includes a developer conveying path so as to convey the recycled toner therethrough. A screening member having openings to screen the recycled toner is arranged in the developer conveying path.

15 Claims, 6 Drawing Sheets

ELECTROPHOTOGRAPHIC APPARATUS HAVING SCREENING MEMBER FOR RECYCLING TONER

CROSS-REFERENCE TO RELATED APPLICATIONS

This application claims priority under 35 USC§119 and contains subject matter related to Japanese Patent Application No. 11-197284 filed in the Japanese Patent Office on Jul. 12, 1999, the entire contents of which are hereby incorporated by reference herein.

BACKGROUND OF THE INVENTION

1. Field of the Invention

The present invention relates to an electrophotographic apparatus for use in a copying machine, a facsimile, a laser beam printer, or the like, that forms an image by visualizing an electrostatic latent image with a two-component developer containing a mixture of toner and carrier.

2. Discussion of the Background

In a known electrophotographic apparatus, to form a toner image on a recording member such as a transfer sheet, first an electrostatic latent image is formed on a surface of a photoreceptor including a photoconductive element serving as an image bearing member by exposing the surface of the photoreceptor which is uniformly charged. Subsequently, the electrostatic latent image on the photoreceptor is developed with toner, and then the toner image is transferred to the recording member. The transferred toner image is fixed on the recording member under the influence of heat and pressure by a fusing device.

In the above-described electrophotographic apparatus, the toner which is not transferred to the recording member and remains on the surface of the photoreceptor is collected by a cleaning device such as a blade, a brush, etc. Then, the collected toner is kept is a container and disposed or returned to a developing device for reuse in subsequent development. The collected toner typically includes a paper powder (paper dust) which is transferred to the surface of the photoreceptor from a transfer sheet at a transfer sheet. The paper powder on the surface of the photoreceptor is also collected by the cleaning device together with the toner.

With regard to the disposal of toner, there arise some problems. First, the disposal of the waste toner needs to be carried out regularly. Second, a storage space for the collected toner is required, so that the size of the electrophotographic apparatus increases. Third, the disposal of toner is generally contrary to the social demand for reducing waste.

For the above-described reasons, in the electrophotographic apparatus, a demand for recycling toner has increased with increased environmental sensitivity, and a cost reduction has been desired, such as by decreasing the size of the electrophotographic apparatus and extending the useful life of toner. In order to fulfill these demands, a method is employed wherein residual toner on the photoreceptor is collected by a cleaning blade after the toner image on the photoreceptor is transferred to the transfer sheet and is returned to the developing device for recycling.

However, when the toner is recycled in the electrophotographic apparatus, a deterioration of image quality may be caused by the paper powder included in the recycled toner. Specifically, when paper powder of relatively large particle size is attached to a non-image portion, the fiber of the paper powder is likely to be recognized by the human eye on a transfer sheet. Moreover, some paper powders are charged with an opposite polarity to that of the toner particle, and toner particles are likely to attach to the paper powders of opposite polarity. When the paper powder with toner particles is attached to a non-image portion, adhering of toner becomes conspicuous on the transfer sheet.

Typically, the above-described deterioration of image quality has not occurred in a background electrophotographic apparatus using recycled toner. The background electrophotographic apparatus has been configured such that the recycled toner is returned to a reservoir called a toner hopper and is mixed with new toner while being agitated therein. Subsequently, the mixture of the recycled toner and new toner is supplied to the developing device after passing through slit openings of a slitter. Thus, the toner from which the paper powder is removed by the slitter can be supplied to the developing device. However, the above-described reservoir, such as a toner hopper, has not been in great demand from the viewpoint of compact design of the apparatus. Therefore, the configuration of the electrophotographic apparatus has been changed such that the recycled toner is returned directly to the developing device from the cleaning device. A reference will be made to this type of background electrophotographic apparatus referring to FIGS. 5 and 6.

FIG. 5 is a schematic view illustrating a construction of the background electrophotographic apparatus, and FIG. 6 is a schematic view for explaining a behavior of toner in a developing device of the electrophotographic apparatus. In the electrophotographic apparatus of FIG. 5, a cylindrically shaped photoreceptor 41 as an image bearing member is supported so as to rotate in the direction indicated by an arrow. Arranged around the photoreceptor 41, are a charging roller 42, an exposing device 43, a developing device 44, a transfer belt 46, a cleaning blade 47, a rotating blade 48, and a toner returning coil 49. The above-described elements except the transfer belt 46 are housed in a photoreceptor/cleaning unit 50 (hereinafter referred to as a PCU).

The developing device 44 is housed in a case having an opening. At the opening, a developing sleeve 45 is rotatably supported and disposed opposite the surface of the photoreceptor 41. A paddle 54 is rotatably supported and disposed at the position opposite the developing sleeve 45 in the case. On the periphery of the paddle 54, spirals 52 are spirally provided. In the paddle 54, a screw conveyor 53 is provided and supported such that the screw conveyor 53 rotates in the same direction as the paddle 54.

Referring to FIG. 6, new toner and recycled toner enter the developing device 44 from a toner supply opening 51, and then enter the paddle 54 from a toner inlet 56. Subsequently, both new toner and recycled toner are mixed with carrier in the paddle 54, and then are conveyed by the screw conveyor 53 as a two-component developer in the direction indicated by arrow A while being agitated. Further, the two-component developer is discharged from the paddle 54 through a developer outlet 55, and then is conveyed by the spirals 52 in the direction indicated by arrow B.

In the above-described background electrophotographic apparatus, when image forming operations are performed for a long term, the toner particles attach to the paper powder which has opposite polarity to that of the toner particles, and thereby the adhering of toner at a non-image portion typically occurs. Moreover, the fiber of the paper powder of relatively large size becomes conspicuous on the non-image portion of the transfer sheet.

SUMMARY OF THE INVENTION

The present invention has been made in view of the above-discussed and other problems, and an object of the present invention is to address these problems.

Accordingly, a further object of the present invention is to provide a novel electrophotographic apparatus including a toner recycling mechanism that can obtain an appropriate image without deterioration of image quality in a compact configuration.

These objects and others are achieved according to the present invention by providing a novel electrophotographic apparatus which forms an electrostatic latent image on a photoreceptor and includes a developing device configured to accommodate a two-component developer including toner and carrier and to develop the electrostatic latent image with the developer. The toner which has been used for developing the electrostatic latent image is recycled to the developing device so as to be used again. The developing device includes a developer conveying path so as to convey the recycled toner therethrough. A screening member having openings to screen the recycled toner is arranged in the developer conveying path.

Preferably, the size of the openings of the screening member is greater than twice a volume mean particle diameter of the carrier and smaller than a size of an opening of 10 mesh.

The developing device may further include a rubbing member which rubs against the screening member.

A size of the screening member may be 10 $mm^2$ or more.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
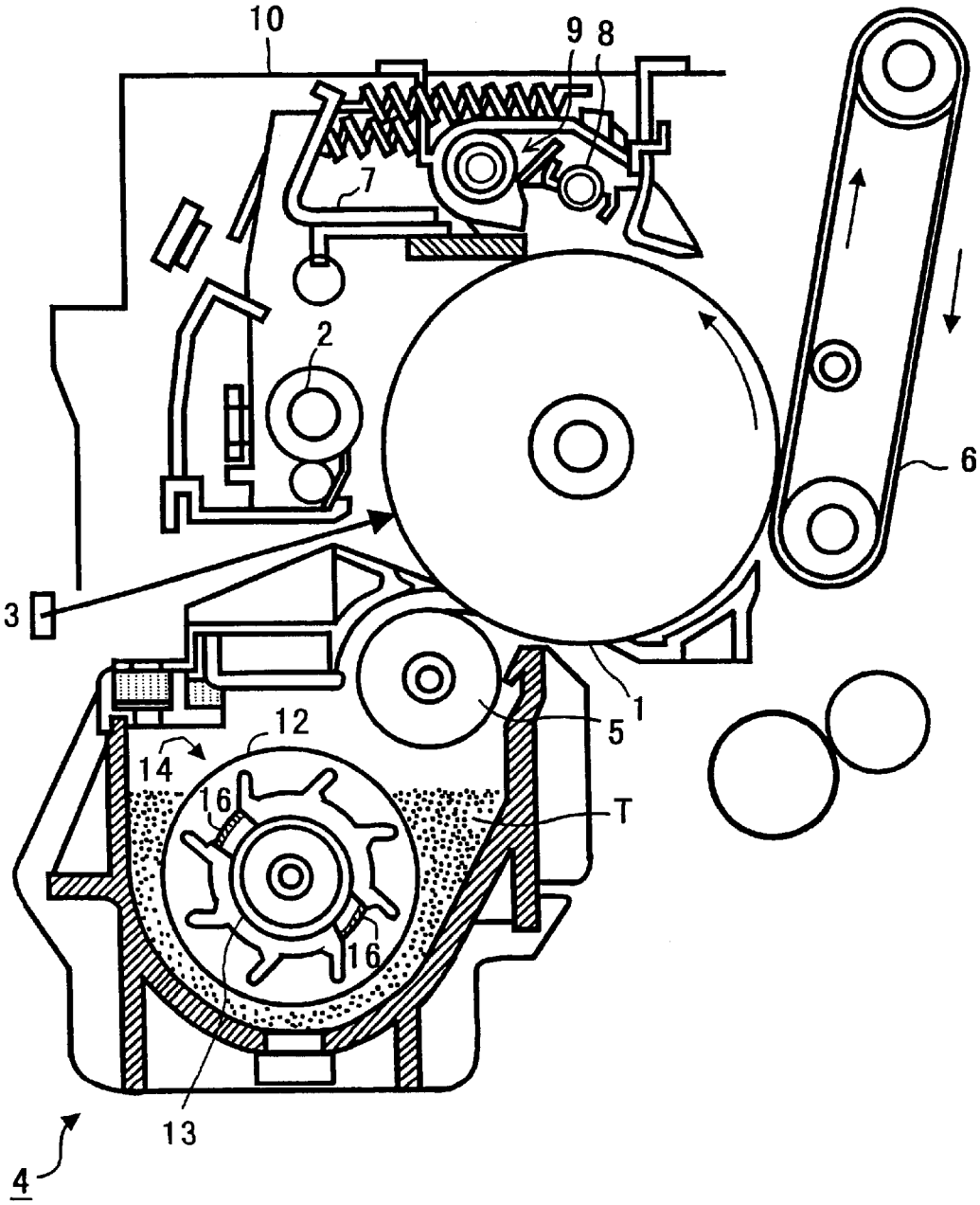
FIG. 1 is a schematic side view illustrating a construction of an electrophotographic apparatus according to a first embodiment of the present invention.

Referring now to the drawings, wherein like reference numerals designate identical or corresponding parts throughout the several views, embodiments of the present invention are now described.

FIG. 1 is a schematic view illustrating a construction of an electrophotographic apparatus according to a first embodiment of the present invention. In the electrophotographic apparatus of FIG. 1, a cylindrically shaped photoreceptor 1 as an image bearing member is supported so as to rotate in the direction indicated by an arrow. Arranged around the photoreceptor 1, are a charging roller 2, an exposing device 3, a developing device 4, a transfer belt 6, a cleaning blade 7, a rotary blade 8, and a toner returning coil 9. The above-described elements except the transfer belt 6 are housed in a photoreceptor/cleaning unit 10 (hereinafter referred to as a PCU).

The developing device 4 is housed in a case having an opening. At the opening, a developing sleeve 5 is rotatably supported and disposed opposite the surface of the photoreceptor 1. A paddle 14 is rotatably supported and disposed at the position opposite the developing sleeve 5 in the case. On the periphery of the paddle 14, spirals 12 are provided. In the paddle 14, a screw conveyor 13 is provided and supported such that the screw conveyor 13 rotates in the same direction as the paddle 14.

An operation of the above-described electrophotographic apparatus is next described. After the photoreceptor 1 is uniformly charged by the charging roller 2, the exposing device 3 exposes the surface of the photoreceptor 1, and thereby an electrostatic latent image is formed on the photoreceptor 1. In the developing device 4, a two-component developer T is accommodated. The two-component developer T is a mixture of magnetic powder called carrier and non-magnetic toner. When the developer T is agitated by the paddle 14, the toner is charged by friction. The developer T including the charged toner is attracted to the developing sleeve 5 and is conveyed by the rotations of the developing sleeve 5. Subsequently, the toner on the developing sleeve 5 is transferred to the surface of the photoreceptor 1 at the position where the developing sleeve 5 faces the photoreceptor 1. The electrostatic latent image on the photoreceptor 1 is developed with toner, and thereby a toner image is formed on the photoreceptor 1. A voltage of opposite polarity to that of toner is applied to the transfer belt 6 by a power source (not shown). The toner image on the photoreceptor 1 is transferred to a transfer sheet at a transfer station between the photoreceptor 1 and the transfer belt 6 by an electric field generated at the transfer station. Subsequently, the transfer sheet with the toner image is conveyed to a fixing device (not shown) by the transfer belt 6. The toner image is fused on the transfer sheet while passing through the fixing device. The toner which is not transferred to the transfer sheet and remains on the photoreceptor 1 is removed by the cleaning blade 7 and is then guided to the toner returning coil 9 by the rotary blade 8. Subsequently, the toner is returned to the developing device 4 as a recycled toner by the toner returning coil 9.

Figure 2:
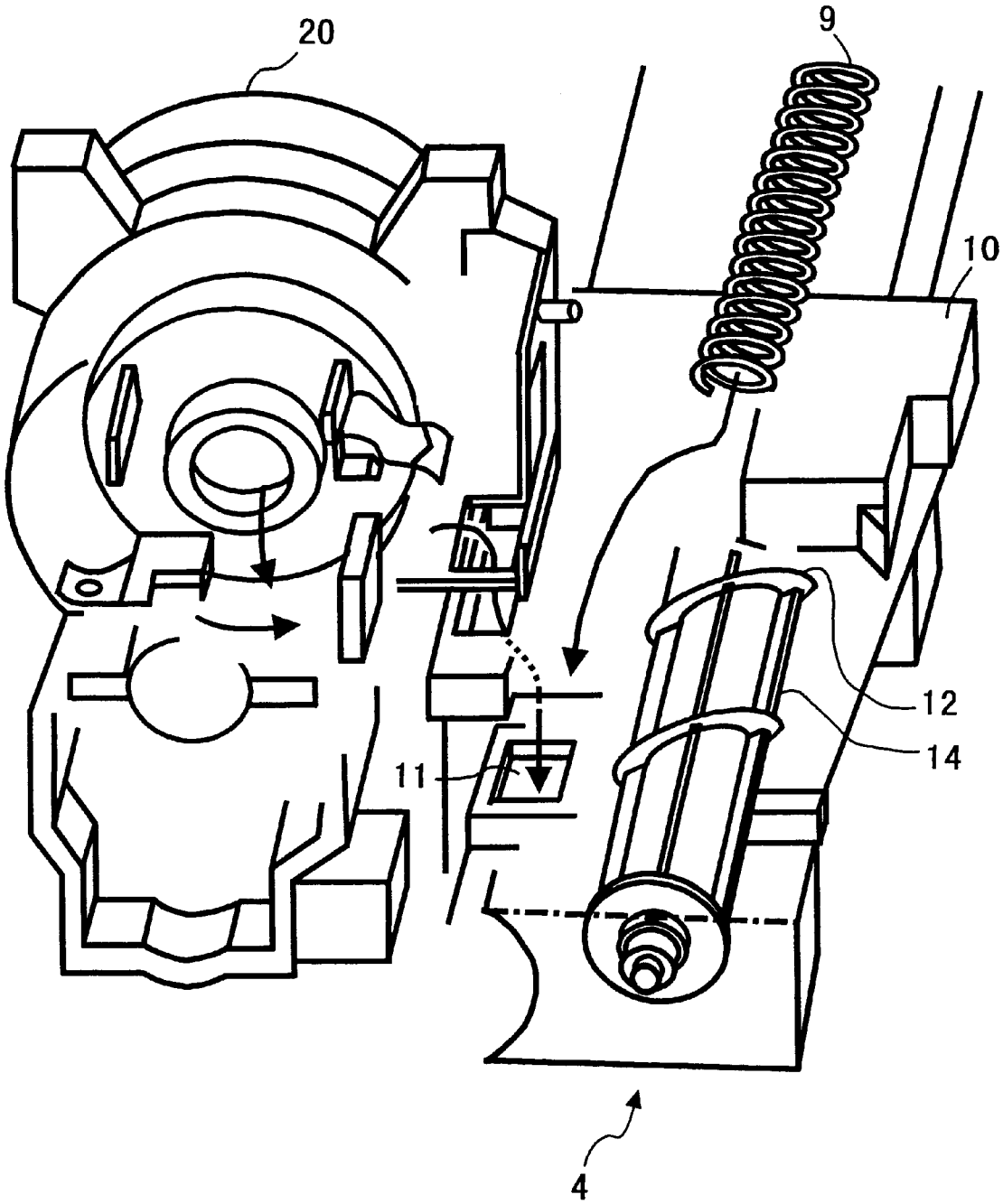
FIG. 2 is a schematic perspective view illustrating toner supplying paths to a developing device from a toner returning coil and a toner supply unit of the electrophotographic apparatus of FIG. 1.

FIG. 2 illustrates toner supplying paths to the developing device 4 from the toner returning coil 9 and a toner supply unit 20. The toner returning coil 9 is provided in the PCU 10. At an end part of the PCU 10, a toner supply opening 11 is provided to communicate with the developing device 4. The recycled toner is supplied from the toner supply opening 11 into the developing device 4. New toner is replenished from the toner supply unit 20 into the developing device 4 also through the toner supply opening 11.

Figure 3:
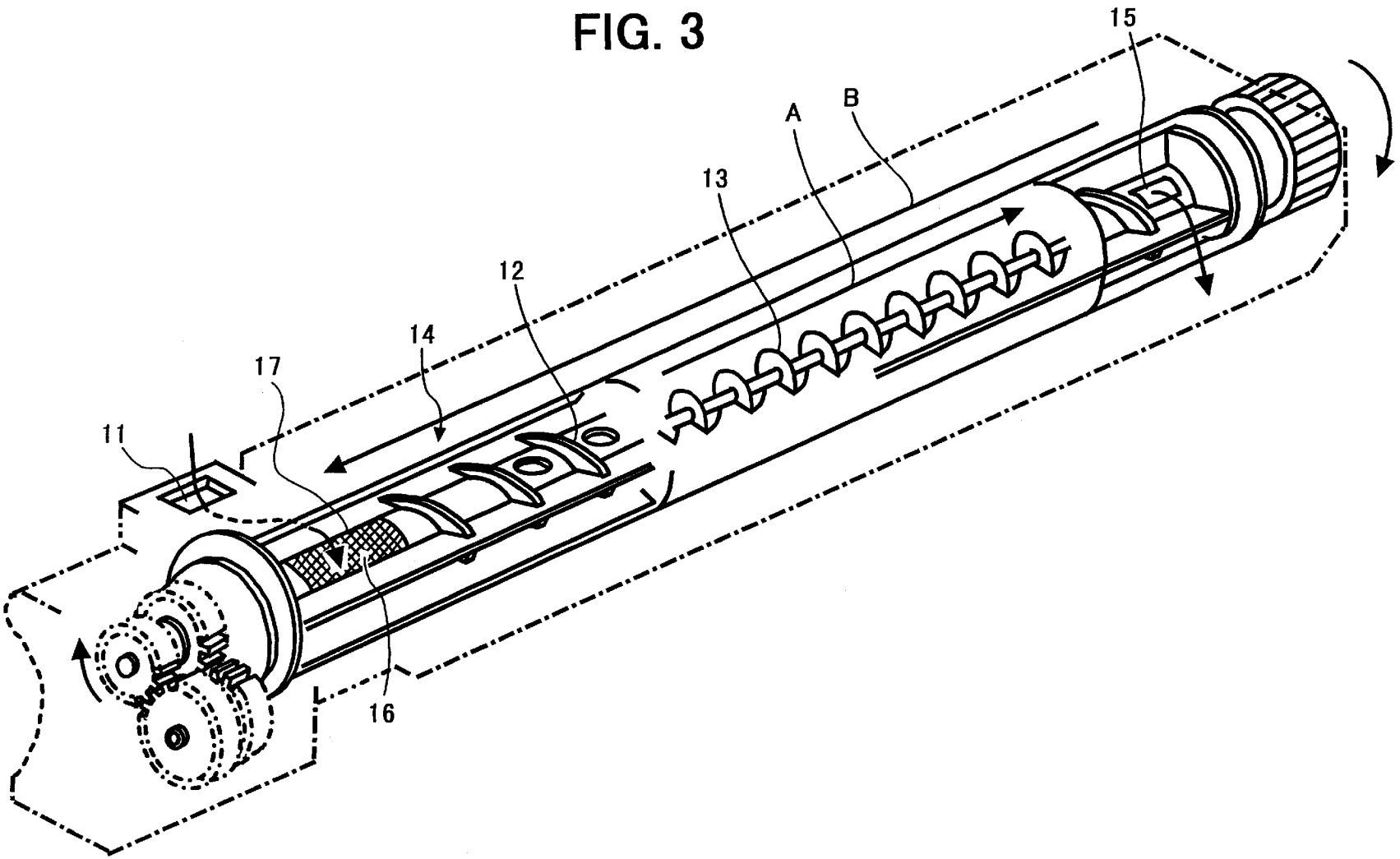
FIG. 3 is a schematic perspective view for explaining a behavior of toner in the developing device of the electrophotographic apparatus of FIG. 1.

FIG. 3 is a schematic view for explaining a behavior of toner in the developing device 4 of the electrophotographic apparatus. Both new toner and recycled toner enter the developing device 4 from the toner supplying opening 11, and then enter the paddle 14 from a toner inlet 17. Subsequently, both new toner and recycled toner are mixed with carrier in the paddle 14, and are then conveyed as a two-component developer by the screw conveyor 13 in the direction indicated by arrow A while being agitated. Further, the two-component developer is discharged from the paddle 14 through a developer outlet 15, and is then conveyed by the spirals 12 in the direction indicated by arrow B. In the first embodiment of the present invention, a mesh member 16 is attached to the toner inlet 17 of the paddle 14 in a developer conveying path. The mesh member 16 has meshes which allow particles of carrier and toner of the developer T to pass through the mesh member 16. When the recycled toner is supplied from the toner inlet 17, a paper powder included in the recycled toner and whose size is more than a predetermined size can not pass through the mesh member 16 and can not enter the paddle 14. As a result, the paper powder which can not enter the paddle 14 stays around the toner supply opening 11 outside the paddle 14 and continues to be agitated. With long-term agitation, the paper powder is crushed to an extent that the paper powder can pass through the meshes of mesh member 16. Because the recycled toner including paper powder whose size is less than a predetermined size is used for development, even though the paper powder is attached to a non-image portion of a transfer sheet, the fiber of the paper powder is not likely to be recognized by the human eye. Moreover, when toner particles attach to the paper powder which has an opposite polarity to that of the toner particle, the amount of toner particles attached to the paper powder is typically small because the size of the paper powder is less than a predetermined size. Therefore, even when the paper powder with toner particles is attached to the non-image portion, adhering of toner becomes inconspicuous on the transfer sheet.

Hereinafter, the mesh member 16 is further described. When the meshes of the mesh member 16 are coarse, a relatively large sized paper powder passes through the mesh member 16, so that the deterioration of image quality is caused by the recycled toner. When the meshes of the mesh member 16 are too fine, the developer can not pass through the mesh member 16, so that the developer stays around the toner supply opening 11 and overflows. Thus, selection of the size of the meshes of the mesh member is important.

The size of each of the meshes of the mesh member 16 needs to be greater than the particle diameter of the carrier of the developer T. Through experiments, it has been found that when each size of the meshes of the mesh member 16 is less than two times of the particle diameter of the carrier, the developer T can not smoothly pass through the mesh member 16, so that the developer T stays around the toner supply opening 11. Therefore, if the volume mean particle diameter of the carrier is 80 $\mu$m, the size of each of the meshes of the mesh member 16 needs to be 160 $\mu$m or more. If the mesh member 16 is metallic, the size of each of the meshes of the mesh member 16 is preferably 90 mesh or greater in view of a diameter of the metal wire. Further, if each size of the meshes of the mesh member 16 is greater than a size of a mesh of 10 mesh, the deterioration of image quality is typically caused by the paper powder in the recycled toner. It has been found through experiments that the most preferable size of the mesh of the mesh member 16 is in a range of 20 mesh to 40 mesh. The size of the mesh member 16 is preferably 10 $mm^2$ or more.

In a background electrophotographic apparatus using a recycled toner, foreign substances in the recycled toner are removed by a mesh member which is provided in a conveying path of the recycled toner. However, in the above-described background electrophotographic apparatus, the meshes of the mesh member are easily clogged by the recycled toner, because the fluidity of the recycled toner is low. In the electrophotographic apparatus of the present invention, the meshes of the mesh member 16 are not likely to be clogged due to the low fluidity of the recycled toner, because the recycled toner passes through the mesh member 16 after having been dispersed in the developer T. Specifically, the fluidity of the recycled toner becomes higher after the recycled toner is mixed with the developer T owing to the magnetic carrier particles included in the developer T. Moreover, when the size of the mesh of the mesh member 16 is selected from the above-described range, the meshes of the mesh member 16 are not likely to be clogged. Even though the toner attaches to the mesh member 16, the carrier removes the toner from the mesh member 16 by attracting the toner by its magnetic force and cleans the meshes of the mesh member 16 while passing through the meshes. Thus, the magnetic carrier in the developer T serves to avoid clogging of the mesh member 16.

Figure 4:
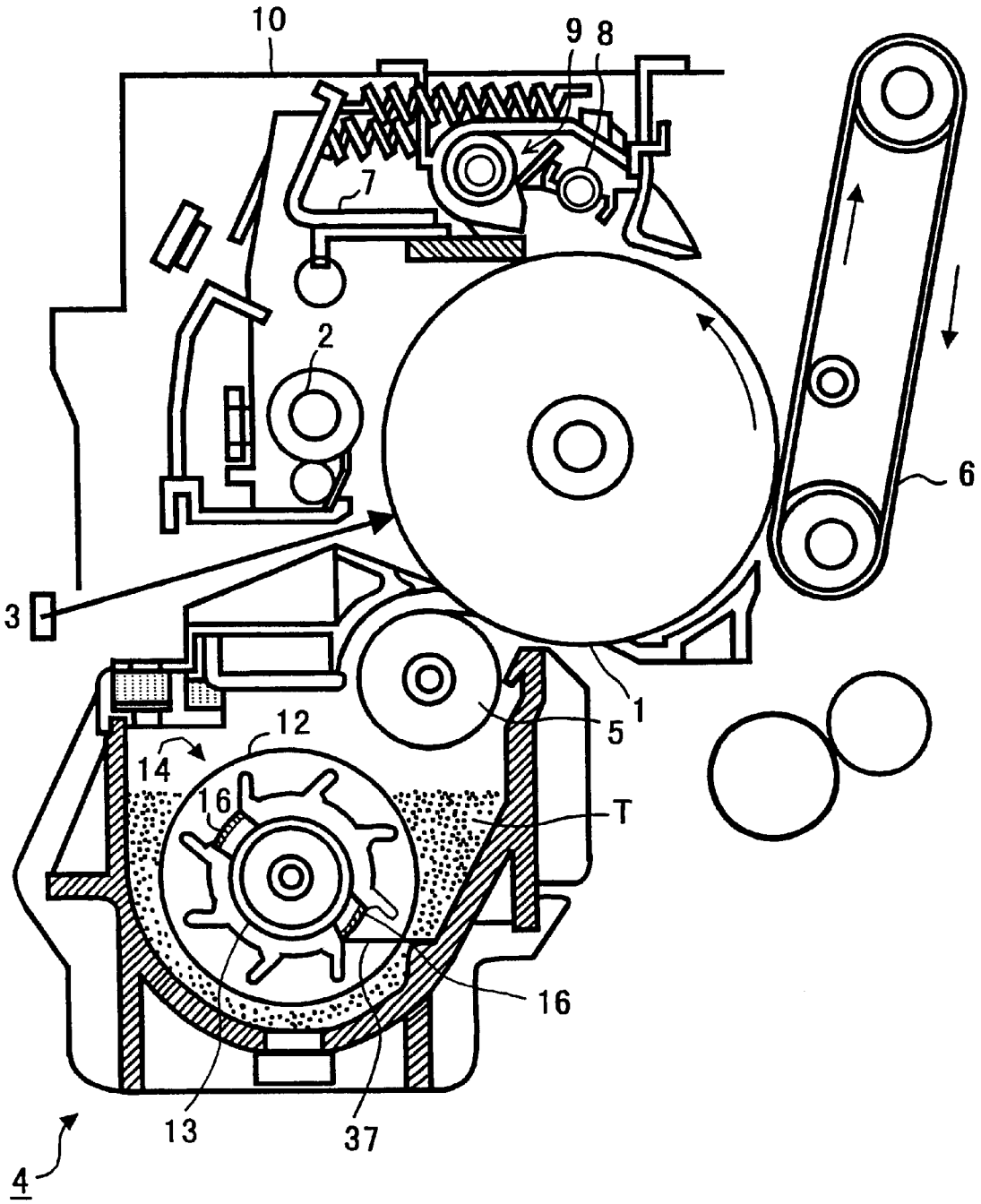
FIG. 4 is a schematic side view illustrating a construction of an electrophotographic apparatus according to a second embodiment of the present invention.
Figure 5:
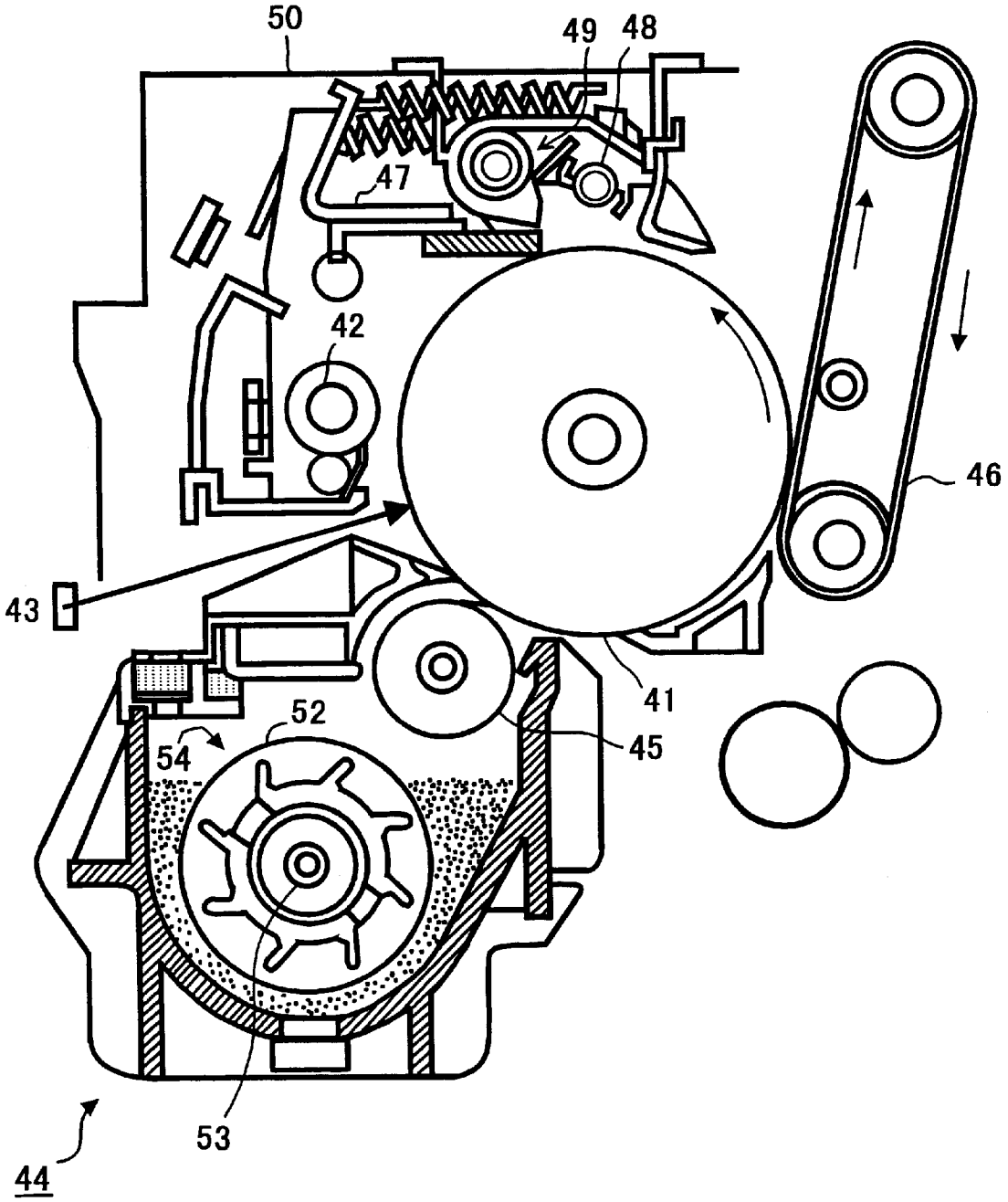
FIG. 5 BACKGROUND ART
FIG. 5 is a schematic side view illustrating a construction of a background electrophotographic apparatus.
Figure 6:
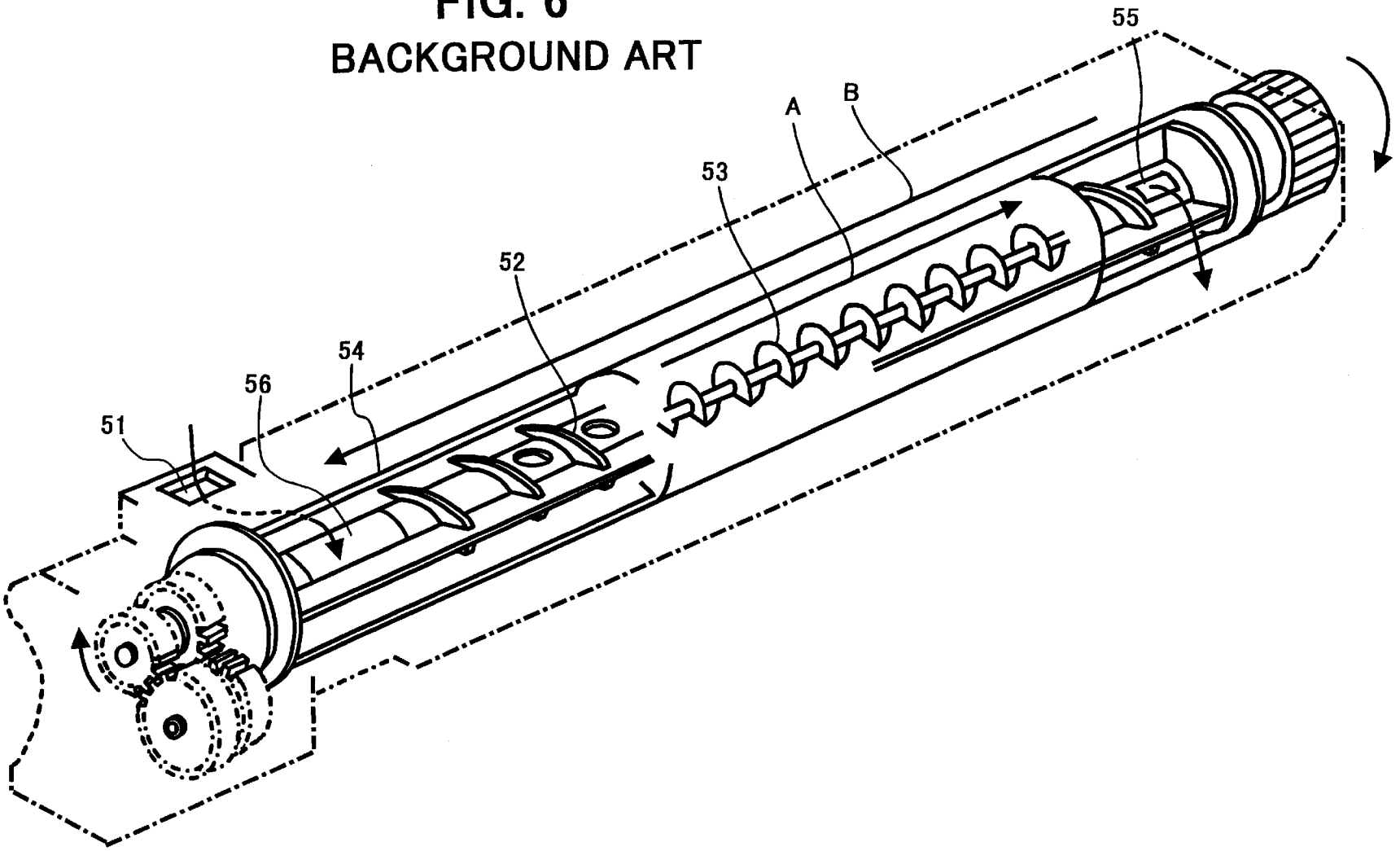
FIG. 6 BACKGROUND ART
FIG. 6 is a schematic perspective view for explaining a behavior of toner in a developing device of the background electrophotographic apparatus of FIG. 5.

Next, an electrophotographic apparatus according to a second embodiment of the present invention is described. FIG. 4 is a schematic view illustrating a construction of the electrophotographic apparatus according to the second embodiment of the present invention. Elements and operations of the electrophotographic apparatus according to the second embodiment of the present invention. Elements and operations of the electrophotographic apparatus in the second embodiment are substantially the same as those of the electrophotographic apparatus of the first embodiment except a rubbing member 37. In the paddle 14 of the developing device 4, the mesh member 16 is attached to the toner inlet 17, and the rubbing member 37, which is made of a thin resilient member such as mylar (trademark), is attached to an inner wall of the case of the developing device 4. It is configured that the tip portion of the rubbing member 37 rubs against the mesh member 16 when the mesh member 16 passes a position opposite the rubbing member 37 by the rotations of the paddle 14. By rubbing of the rubbing member 37, the two-component developer and the paper powder in the recycled toner are positively rubbed against the mesh member 16, and thereby the paper powder is crushed into small particles. Further, the meshes of the mesh member 16 are cleaned and prevented from being clogged. Owing to the above-described configuration employing the rubbing member 37, the size of the mesh of the mesh member 16 can be smaller, and the recycled toner including paper powders which are crushed into smaller particles can be used for development. As a result, even though the paper powder is attached to a non-image portion of a transfer sheet, the fiber of the paper powder is not likely to be recognized by the human eye. Moreover, even when toner particles attach to the paper powder which has an opposite polarity to that of the toner particle and when the paper powder with toner particles is attached to a non-image portion, adhering of toner on the transfer sheet becomes inconspicuous.

As described above, in the electrophotographic apparatus according to the first and second embodiments of the present invention, an appropriate image without deterioration of image quality can be obtained.

Numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the U.S. is:

1. An electrophotographic apparatus which forms an electrostatic latent image on a photoreceptor, comprising:

a developing device configured to accommodate a two-component developer including toner and carrier and to develop the electrostatic latent image with the developer;

wherein the toner which has been used for developing the electrostatic latent image is recycled to the developing device so as to be used again; and the developing device including, a developer conveying path so as to convey the recycled toner therethrough, mix the recycled toner with carrier, and recirculate the recycled toner mixed with carrier, and a screening member having openings to screen the recycled toner mixed with carrier arranged in the developer conveying path.

2. The electrophotographic apparatus according to claim 1, wherein a size of each of the openings of the screening member is greater than twice a volume mean particle diameter of the carrier and smaller than a size of an opening of 10 mesh.

3. The electrophotographic apparatus according to claim 1, wherein the developing device further includes a rubbing member which rubs against the screening member.

4. The electrophotographic apparatus according to claim 1, wherein a size of the screening member is 10 $mm^2$ or more.

5. An electrophotographic apparatus which forms an electrostatic latent image on a photoreceptor, comprising:

a developing device configured to accommodate a two-component developer including toner and carrier and to develop the electrostatic latent image with the developer;

wherein the toner which has been used for developing the electrostatic latent image is recycled to the developing device so as to be used again; and the developing device including, a developer conveying path so as to convey the recycled toner therethrough, mix the recycled toner with carrier, and recirculate the recycled toner mixed with carrier, and a mesh member having meshes to screen the recycled toner mixed with carrier arranged in the developer conveying path.

6. The electrophotographic apparatus according to claim 5, wherein a size of each of the meshes of the mesh member is greater than twice a volume mean particle diameter of the carrier and smaller than a size of a mesh of 10 mesh.

7. The electrophotographic apparatus according to claim 5, wherein the developing device further includes a rubbing member which rubs against the mesh member.

8. The electrophotographic apparatus according to claim 5, wherein a size of the mesh member is 10 $mm^2$ or more.

9. An electrostatic apparatus which forms an electrostatic latent image on a photoreceptor, comprising:

means for accommodating a two-component developer including toner and carrier and for developing the electrostatic latent image with the developer;

wherein the toner mixed with carrier which has been used for developing the electrostatic latent image is recycled to the developing means so as to be used again; and said developing means including, a developer conveying path so as to convey the recycled toner therethrough, mix the recycled toner with carrier, and recirculate the recycled toner mixed with carrier, and screening means for screening the recycled toner mixed with carrier, the screening means arranged in the developer conveying path, and having openings to screen the recycled toner mixed with carrier.

10. The electrophotographic apparatus according to claim 9, wherein each size of the openings of the screening means is greater than twice a volume mean particle diameter of the carrier and smaller than a size of an opening of 10 mesh.

11. The electrophotographic apparatus according to claim 9, wherein the developing means further includes a rubbing means which rubs against the screening means.

12. The electrophotographic apparatus according to claim 9, wherein a size of the screening means is 10 $mm^2$ or more.

13. An electrophotographic apparatus which forms an electrostatic latent image on a photoreceptor, comprising:

a developing device configured to accommodate a two-component developer including toner and carrier and to develop the electrostatic latent image with the developer;

wherein the toner which has been used for developing the electrostatic latent image is recycled to the developing device so as to be used again; and the developing device including, a developer conveying path so as to convey the recycled toner therethrough, mix the recycled toner with carrier, and recirculate the recycled toner mixed with carrier, a screening member having openings to screen the recycled toner mixed with carrier arranged in the developer conveying path, and an agitation member for agitating recycled toner mixed with carrier such that paper powder particles within the recycled toner mixed with carrier are reduced to a predetermined size so as to pass through the screening member.

14. An electrophotographic apparatus which forms an electrostatic latent image on a photoreceptor, comprising:

a developing device configured to accommodate a two-component developer including toner and carrier and to develop the electrostatic latent image with the developer, wherein the toner mixed with carrier which has been used for developing the electrostatic latent image is recycled to the developing device so as to be used again; and the developing device including:

a developer conveying path so as to convey the recycled toner therethrough, mix the recycled toner with carrier, and recirculate the recycled toner mixed with carrier, a mesh member having meshes to screen the recycled toner mixed with carrier, arranged in the developer conveying path, and an agitation member for agitating recycled toner mixed with carrier such that paper powder particles within the recycled toner mixed with carrier are reduced to a predetermined size so as to pass through the mesh member.

15. An electrostatic apparatus which forms an electrostatic latent image on a photoreceptor, comprising:

means for accommodating a two-component developer including toner and carrier and for developing the electrostatic latent image with the developer;

wherein the toner which has been used for developing the electrostatic latent image is recycled to the developing means so as to be used again; and said developing means including, a developer conveying path so as to convey the recycled toner therethrough, mix the recycled toner with carrier, and recirculate the recycled toner mixed with carrier, screening means for screening the recycled toner mixed with carrier, the screening means arranged in the developer conveying path, and having openings to screen the recycled toner mixed with carrier, and agitation means for agitating recycled toner mixed with carrier such that paper powder particles within the recycled toner mixed with carrier are reduced to a predetermined size so as to pass through the screening means.

* * * * *